US006908157B1

(12) United States Patent
Avedissian et al.

(10) Patent No.: US 6,908,157 B1
(45) Date of Patent: Jun. 21, 2005

(54) PORTABLE ARMREST ASSEMBLY

(76) Inventors: David Michael Avedissian, 749 Stephan Rd., Burbank, CA (US) 91504; Ryan Raney Harris, 13930 Old Harbor La., Apt 103, Marina del Rey, CA (US) 90292-7319

( * ) Notice: Subject to any disclaimer, the term of this patent is extended or adjusted under 35 U.S.C. 154(b) by 0 days.

(21) Appl. No.: 10/828,064

(22) Filed: Apr. 20, 2004

Related U.S. Application Data

(60) Provisional application No. 60/464,666, filed on Apr. 21, 2003.

(51) Int. Cl.[7] ..... A47C 7/54
(52) U.S. Cl. ..... 297/411.24; 297/411.27
(58) Field of Search ..... 297/411.23, 411.24, 297/411.26, 411.27, 411.28; 248/118.3

(56) References Cited

U.S. PATENT DOCUMENTS 2,659,423 A * 11/1953 Haley ..... 297/411.24 X
5,918,840 A * 7/1999 Christensen ..... 297/411.23 X
6,511,131 B1 * 1/2003 Harnois ..... 297/411.23

* cited by examiner

*Primary Examiner*—Anthony D. Barfield
(74) *Attorney, Agent, or Firm*—Roger A. Marrs

(57) ABSTRACT

A portable single-sided armrest assembly that is added to or removed from any seating device/location without requiring any fixed mounting or permanent or semi-permanent attachment means. The armrest assembly includes an L-shaped member having a lower plate section serving as a seat for the person using the armrest while further including a backplate section which slidably mounts an upright support plate or portion. One end of the support plate includes an elongated cushion armrest fixedly attached thereto, while further including an elongated slot mounting a threaded cap serving as a guide as the support plate is moved to a desired vertical position. A lock knob is employed for securing the armrest and support plate in a fixed location on the backplate. An adapter plate is employed for attachment between an angular section joining the backplate of the L-shaped member to the lower seat section of the member, wherein the adapter is employed to occupy a vacant right angled space in a standard seat. Without the adapter, a sloped plate on the L-shaped member provides added support when a seat, such as when a bucket-type, is employed.

9 Claims, 1 Drawing Sheet

10
11
12
13
14
15
16
17
18
20
21
22
23
24
25
26
27
28
30
31
32
33
35
36
4

PORTABLE ARMREST ASSEMBLY

Priority claimed on Ser. No. 60/464,666 filed Apr. 21, 2003 now abandoned.

BACKGROUND OF THE INVENTION

1. Field of the Invention

The present invention relates to the field of armrests or supports, and more particularly to a novel portable arm support having a seat portion on which the user sits and an adjustable arm support with a cushion projecting upwardly from the seat portion.

2. Brief Description of the Prior Art

Armrests serve an important function to provide comfort, reduce fatigue and improve posture while seated. There are many different armrest configurations. Some armrests are integrated into the seating device, as is the case with a sofa, love seat and park bench. Other armrests are located on a structure adjacent to the seating devices, such as the door in many cars, trucks and small aircraft. Many armrests are separate assemblies that are attached to the seating device, as is the case with office chairs.

It is very important that the armrest be stable so that it remains stationary as the arm of the user applies a load force to it. For this reason, nearly all armrests, including highly adjustable armrests, are permanently fastened in place. Armrest assemblies may be attached in place by any number of permanent or semi-permanent methods including but not limited to the use of mounting brackets, mounting hardware, male-female or female-male adapters, glue or clips.

Even though armrests stand to benefit both the left and right arms equally, many seating devices/locations only provide the user with one usable armrest at a time. The following partial list of examples includes the sofa couch and park bench which have two armrests, but they are so far apart from one another that a person can only use one at a time. Many small aircraft cockpits and pickup trucks with bench seats have armrests in each of the two doors, but not in the center. The two door armrests are too far apart to rest both arms on at the same time and were clearly never intended to be used for both arms. As a result of small aircraft cockpits only having one armrest many pilots go without an armrest in the inside arm. This can cause fatigue and discomfort, especially on long flights and strenuous activities. This problem affects two-seat training aircraft all the way up to corporate jets. This invention solves the problem and allows pilots and drivers of cars to use two armrests.

Adding a second armrest in the aforementioned seating device and other single-armrest seating devices/locations is impractical in many situations for several reasons. One reason is that after-market assemblies are not always available for a given seating device or location. Even if they are available, they cannot be permanently mounted (bolted or screwed in place) without permission from the owner of the seating device. This limits their use in rental cars and trucks, rented or chartered small airplanes, public places (park benches, stadium bleachers, high school gymnasiums), or friend's houses. When the use of the seating device is temporary, like a football game or a short ride in a taxi, permanent installation becomes even more out-of-the-question.

Therefore, a long-standing need has existed to provide a portable armrest employing the user's weight to provide stability and balance and which is adjustable for height and angular positioning for use in the aforementioned seating situations.

SUMMARY OF THE INVENTION

The above problems and difficulties are avoided by the present invention which provides a portable single-sided armrest assembly that can be added to or removed from any seating device/location without requiring any mounting or permanent or semi-permanent attachment means. The armrest assembly includes an L-shaped member having a lower section which serves as a seat for the person using the armrest while further including an upright back section which slidably mounts a support plate. One end of the support plate includes an elongated cushion armrest fixedly attached thereto, while the body thereof includes an elongated slot mounting a threaded cap serving as a guide as the support plate is moved to a desired vertical position. A lock knob is employed for securing the armrest and support plate in a fixed location with respect to the L-shaped member. An adapter plate is employed for attachment between an angular section joining the upper back section of the L-shaped member to the lower seat section of the member, wherein the adapter is employed to occupy a vacant space and to provide added support when a seat, such as a bucket-type, is employed.

The L-shaped assembly places the lower seat section on the seat of a standard chair while the user sits directly on the seat section serving as a weight for holding the armrest in position with respect to the basic seat. The weight of the user on the seat-section secures the overall armrest assembly in place.

Therefore, it is among the primary object os the present invention to provide a portable and universal armrest assembly which includes stability and balance for the user's arm as it is rested on top of a vertical portion of the assembly.

Another object of the present invention is to provide a portable, single-sided armrest assembly that may be placed on a conventional seat with the user sitting on a portion of the assembly so that an instant armrest is provided and which may be carried away to another location after the user has left the basic seat.

Yet another object-resides in providing a portable armrest assembly which includes adjustability in one or more axes.

Still a further object of the invention resides in providing a single armrest with a pivoting accessory arm for supporting an accessory usable to the user, such as a cup holder or instrument.

A further object resides in providing an armrest which provides a stable and secure platform having a pivotal arm for a variety of accessories.

Another object of the present invention resides in providing a portable armrest assembly which does not require permanent fastening to a seating device nor requires the employment of screws or bolts or other permanent means in order for the assembly to function properly.

Yet a further object resides in providing an armrest assembly which may be placed on any conventional basic seat and employing the weight of the user for stability and balance for the user's arm.

BRIEF DESCRIPTION OF THE DRAWINGS

The features of the present invention which are believed to be novel are set forth with particularity in the appended claims. The present invention, both as to its organization and manner of operation, together with further objects and advantages thereof, may best be understood with reference to the following description, taken in connection with the accompanying drawings in which:

DESCRIPTION OF PREFERRED EMBODIMENT

Figures 1, 2, 3, 4, 5:
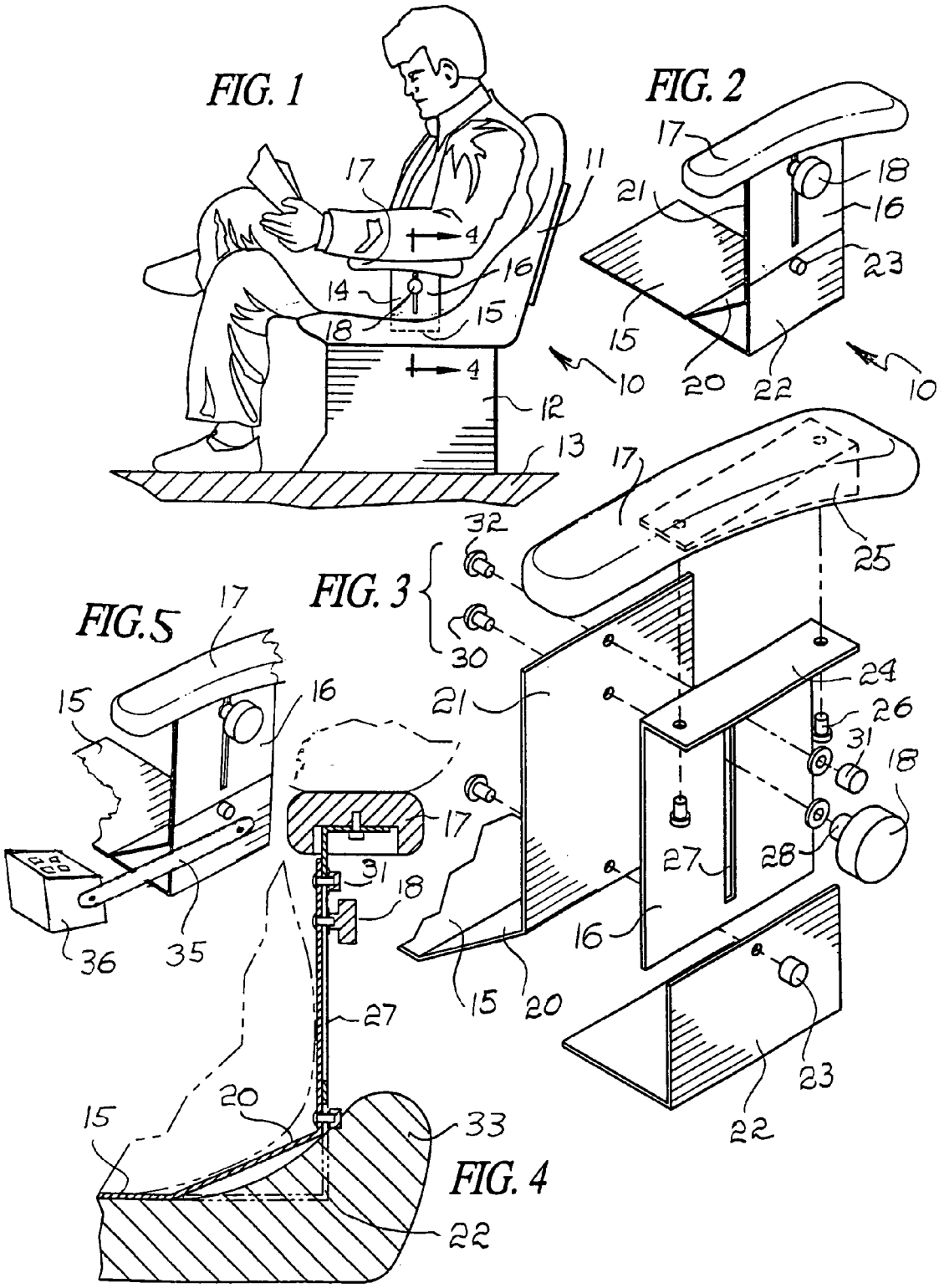
FIG. 1 is a side elevational view of the novel portable armrest incorporating the present invention.
FIG. 2 is a front perspective view of the armrest shown in FIG. 1.
FIG. 3 is an exploded perspective view illustrating the components comprising the armrest shown in FIGS. 1 and 2.
FIG. 4 is a transverse cross-sectional view of the armrest as shown in FIG. 1 as taken in the direction of arrows 4—4 thereof.
FIG. 5 is a reduced perspective view of the armrest incorporating a pivotal accessory arm.

Referring to FIG. 1, the novel portable armrest incorporating the present invention is illustrated in the general direction of arrow 10 and is used in connection with a conventional seat 11 which is supported on a base 12 connected to flooring 13. The conventional seat 11 does not include a built-in armrest for supporting the occupant's left arm. However, the opposite side of the seat may include a built-in armrest for the right arm or, if not built-in, another portable armrest may be employed. The portable armrest includes an L-shaped member 14 having an upright support plate and a seat plate. The seat plate is indicated by numeral 15, while the upright or vertical support plate is indicated by numeral 16. An armrest 17 composed of a cushioned material is carried on the top of the upright plate 16 and the user's arm is resting thereon. The armrest 17 may be raised or lowered for the convenience of the occupant by a lock-knob 18.

Referring now in detail to FIG. 2, the portable armrest 10 is seen to include a backplate 21 which is integrally connected to the seat portion 15 by an angular section 20. The vertical or upright plate 16 is slidably carried on the front of the backplate 21 so that the armrest 17 can be raised or lowered. The lock-knob 18 retains the armrest 17 in a fixed position after the plate portion 16 has been placed in a desired position.

An adapter 22 is employed when the armrest is placed in a conventional seat wherein the corner of the seat is of a right angle construction. When such a construction is employed, the adapter 22 is attached to the backplate 21 by means of a threaded connector 23. However, when the conventional seat includes an angular corner, such as a bucket seat, the adapter 22 is removed and the angular section 20 of the armrest is placed in the angular construction of the conventional seat.

Referring now in detail to FIG. 3, it can be seen that the upper edge of the upright support plate 16 terminates in a flange 24 that is connected to a mounting block 25 supporting the armrest 17. Screw-type fasteners, such as screw 26, are employed for connecting the flange 24 to the mounting block 25 and the armrest 17. It is also to be noted that the upright support plate 16 includes a vertical slot 27 that receives a shank 28 on the backside of the lock-knob 18. The shank 28 is threadably engageable with a fastener 30 so that when loosened, the plate 16 may be positioned vertically on the shank 28 so that the armrest 17 is placed in a desired position. Once the position has been reached, the knob 18 is tightened on the screw 30 so that the plate 16 will reside in the selected position. The vertical movement of the upright support plate 16 is against the surface of the backplate 21. A threaded cap 31 is considered a guide means so that the upright support plate or portion 16 will not pivot or twist when the lock-knob is loosened. The threaded cap 31 is engageable with a threaded fastener 32 which projects through the slot 27.

With respect to FIG. 4, it can be seen that the adapter 22 is not needed when the armrest is used in connection with a bucket seat, indicated by numeral 33. However, as shown in broken lines, the adapter 22 would be used with a different type of seat construction when the construction includes a right angle configuration. Knob 18 has been tightened so that there is no movement between the upright support plate 16 and the backplate 21. Also, it is to be noted that when the adapter 22 is used the upper edge of the adapter is in a flush relationship with the bottom edge of the upright support plate or portion 16. The guide cap 31 also, when tightened, retains the backplate 21 and the upright support plate 16 in a releasable fixed relationship in addition to the lock-knob 18. FIG. 4 further illustrates that the occupant of the seat 33 places his body directly on the seat plate or portion 15 of the backplate and that the angular portion 20 comfortably accommodates the occupant's body. The armrest 17 accommodates support for the occupant's arm.

Referring to FIG. 5, an accessory for the portable armrest is illustrated which includes an elongated bar 35 that is connected to the adapter 22 or which may be connected to backplate 21 depending on the type of seat in which the portable armrest is employed. The bar 35 is cantilevered forward of the armrest and includes an accessory, such as a cup-holder, flight instrumentation, or the like. Such a flight device may be a global positioning service device and is illustrated by numeral 36. The bar 35 is positionable by the user so that the push buttons of the flight device 36 are within easy and convenient reach of the occupant while his arm is resting on the armrest 17.

In view of the foregoing, it can be seen that the occupant of a conventional seat without a built-in armrest can readily support his arm by use of the portable armrest of the present invention. The user places the seat plate or portion 15 of the device on the seat of the conventional seat and his body is then placed on seat portion 15. Load forces of the occupant's body will maintain the device in position while supporting the occupant's arm. The armrest 17 may be raised or lowered by means of the lock-knob 18 and the slidable support plate 16. An adapter plate 22 may be used when a seat with right angle construction is encountered. An accessory may be mounted by use of the bar 35. A feature resides in the fact that when the occupant leaves the conventional seat, he may take the armrest 10 with him and may enjoy the comforts thereof in another location. It is again noted that the armrest of the present invention is not permanently attached to flooring, to the conventional seat or to any other permanent structure. The occupant's body is the sole support for the armrest and it is the occupant's weight which holds the armrest in a desired position on a conventional seat.

While particular embodiments of the present invention have been shown and described, it will be obvious to those skilled in the art that changes and modifications may be made without departing from this invention in its broader aspects and, therefore, the aim in the appended claims is to cover all such changes and modifications as fall within the true spirit and scope of this invention

What is claimed is:

1. A portable armrest comprising:

an L-shaped member having a backplate vertically extending from a horizontal seat plate;

a support plate moveably disposed on said backplate;

an armrest fixedly carried on said support plate;

knob-lock means operably carried on said backplate for engaging with said support plate to releasably retain said support plate and said armrest in a selected position;

said seat plate is adapted to be sat upon by an occupant of a standard chair whereby the weight of the occupant stabilizes said armrest; and an angle plate joining said backplate with said seat plate.

2. The armrest defined in claim 1 including:

said support plate having an elongated slot;

said lock-knob having said stud slidably disposed in said slot; and a threaded fastener carried on said backplate in threaded connection with said lock-knob for releasably securing said support plate with said backplate.

3. The armrest defined in claim 2 including:

an armrest having one end attached to said backplate and cantilevered outwardly terminating at its free end with an accessory device.

4. The armrest defined in claim 1 including:

a flange carried on said support plate; and a cushioned armrest secured to said flange.

5. A portable armrest comprising:

a base member having an upright backplate and a seat plate extending outwardly from said backplate at a right angle thereto;

a support plate movably carried on said backplate so as to be adjusted to a desired position;

an armrest secured to said support plate;

releasable means interconnecting said support plate with said backplate for retaining said armrest in said desired position; and an angle plate integrally connecting said backplate with said seat plate.

6. The armrest defined in claim 5 wherein:

said seat plate adapted to be sat upon by an occupant of a standard seat or chair whereby the weight of the occupant stabilizes said armrest.

7. The armrest defined in claim 5 wherein:

said base member, said support plate and said armrest adapted to be moved from place to place as a unitary construction.

8. The armrest defined in claim 7 including:

an accessory;

mounting bar interconnecting said accessory with said backplate so that said accessory projects forwardly of said base member.

9. The armrest defined in claim 8 including:

a right angle plate detachably connectable with said backplate over said angle plate for fitting into the contour of a standard chair or seat.

* * * * *